US009741267B2

(12) United States Patent
de Jong

(10) Patent No.: US 9,741,267 B2
(45) Date of Patent: Aug. 22, 2017

(54) GRIPPING ELEMENT FOR DATA CARRIER FOR VEGETABLES, FRUITS, AND INDOOR PLANTS

(71) Applicant: Joost Arie de Jong, Honselersdijk (NL)

(72) Inventor: Joost Arie de Jong, Honselersdijk (NL)

( * ) Notice: Subject to any disclaimer, the term of this patent is extended or adjusted under 35 U.S.C. 154(b) by 0 days.

(21) Appl. No.: 15/037,097

(22) PCT Filed: Nov. 13, 2014

(86) PCT No.: PCT/EP2014/003065
§ 371 (c)(1),
(2) Date: May 17, 2016

(87) PCT Pub. No.: WO2015/070989
PCT Pub. Date: May 21, 2015

(65) Prior Publication Data

US 2016/0293064 A1 Oct. 6, 2016

(30) Foreign Application Priority Data

Nov. 18, 2013 (NL) ..... 1040503

(51) Int. Cl.

| | |
|---|---|
| ***G09F 3/00*** | (2006.01) |
| ***G09F 3/20*** | (2006.01) |
| ***G09F 3/04*** | (2006.01) |
| ***G09F 3/06*** | (2006.01) |
| ***B65D 33/16*** | (2006.01) |
| *G09F 3/02* | (2006.01) |

(52) U.S. Cl.
CPC ..... *G09F 3/206* (2013.01); *B65D 33/1633* (2013.01); *G09F 3/0295* (2013.01); *G09F 3/04* (2013.01); *G09F 3/06* (2013.01); *G09F 2003/0283* (2013.01)

(58) Field of Classification Search
CPC ..... Y10T 24/155; Y10T 24/44923; B65D 33/1625
USPC ..... 40/316, 637, 645, 661.08
See application file for complete search history.

(56) References Cited

U.S. PATENT DOCUMENTS

| | | | | |
|---|---|---|---|---|
| 4,760,660 A * | 8/1988 | Fast | G09F 3/04 40/308 |
| 6,447,863 B1 * | 9/2002 | Lewin | G09F 3/02 40/359 |
| 7,073,282 B2 * | 7/2006 | Savagian | G09F 3/0295 24/129 B |
| 2008/0011871 A1 | 1/2008 | Sexton | |

FOREIGN PATENT DOCUMENTS

| | | |
|---|---|---|
| JP | H10-153959 A | 6/1998 |
| JP | 2010-39156 A | 2/2010 |
| NL | 1039498 C | 10/2013 |
| WO | 2013/143710 A1 | 10/2013 |

* cited by examiner

*Primary Examiner* — Joanne Silbermann
(74) *Attorney, Agent, or Firm* — Hoffmann & Baron, LLP

(57) ABSTRACT

A gripping element for a data carrier, e.g. a label, for vegetables, fruits, and indoor plants can be used to attach information to vegetables (e.g. vine tomatoes), fruits and indoor plants, among others. The data carrier may be a three-dimensional gripping element obtained from folding and gluing a piece of punched or cut paper, cardboard, or other thin material.

10 Claims, 6 Drawing Sheets

(a)

(b)

(a)

(b)

(a)

(b)

(c)

(a)

(b)

GRIPPING ELEMENT FOR DATA CARRIER FOR VEGETABLES, FRUITS, AND INDOOR PLANTS

CROSS-REFERENCE TO RELATED APPLICATIONS

This application is the National Stage of International Application No. PCT/EP2014/003065 filed Nov. 13, 2014, which claims the benefit of Netherlands Application No. 1040503, filed Nov. 18, 2013, the contents of which is incorporated by reference herein.

FIELD OF THE INVENTION

The present invention relates to a gripping element for a data carrier, e.g. a label, which can be used to attach information to e.g. vegetables (for instance vine tomatoes), fruits, and indoor plants. For simplicity, this document will further mainly refer to the application of the gripping element for a label for vine tomatoes. This does not, however, exclude any of the other possible applications.

BACKGROUND OF THE INVENTION

The way to attach a label to a branch of vine tomatoes, according to the current state of technology, involves packing the tomatoes in film, with or without laying them out first on a tray of e.g. cardboard or plastic, at which point the film can receive a label, e.g. a sticker. This method is not the most sustainable way to attach information to vine tomatoes. Other types of labels are attached using binding wire or a string to a stem of the branch of vine tomatoes, which is time-consuming, and therefore expensive.

SUMMARY OF THE INVENTION

The present invention describes a gripping element made from folding and gluing a punched or cut piece of paper, cardboard or other kind of thin material, which can be attached to a branch of vine tomatoes by bending one or several stems, and where the gripping element is attached to a label or other kind of data carrier using e.g. glue. The gripping element according to this invention may be described as a clip in the remainder of the description and in the conclusions. The invention will now be illustrated using several diagrams.

BRIEF DESCRIPTION OF THE DRAWINGS

The following illustrations show.

In the description and the figures, identical or similar parts are referenced by identical or similar reference numbers.

DETAILED DESCRIPTION OF THE INVENTION

Figure 1:
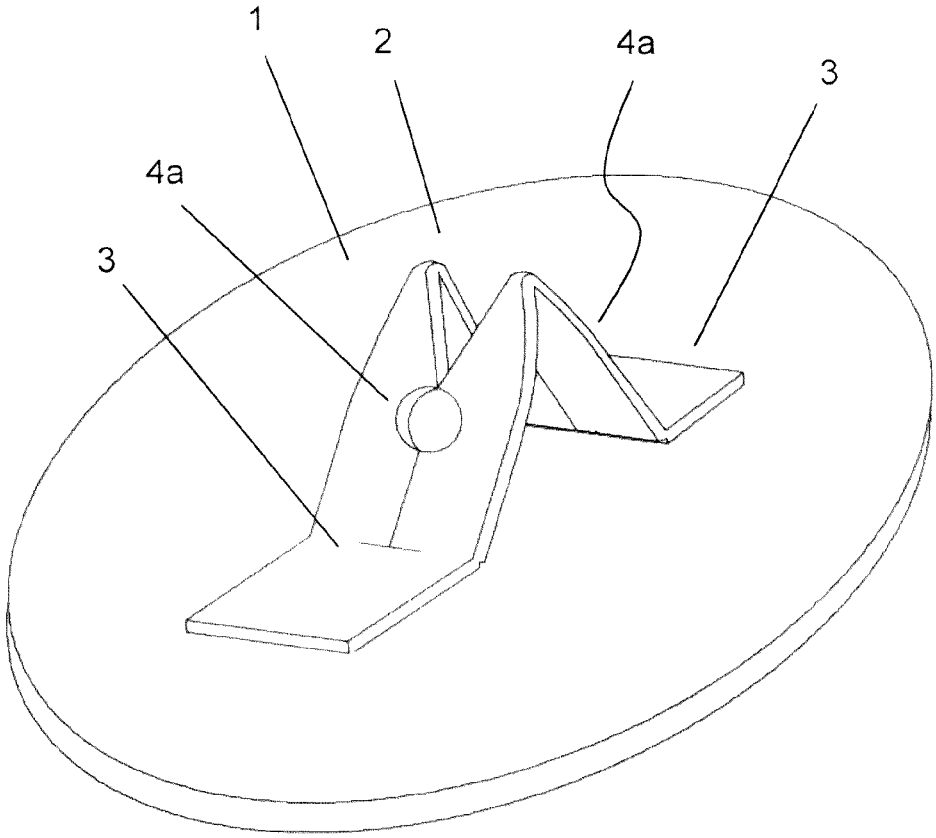
FIG. 1 a schematic back side perspective view of a label with an implementation of a gripping element according to this invention attached to it.

FIG. 1 shows a schematic back side perspective of a data carrier, (1) with an implementation example of a clip attached to it, (2) according to the invention. The fastening of the clip to the label can be done e.g. through gluing.

In this type of implementation and with this way of attaching the clip to the label, the clip has taken a three-dimensional shape, starting with a two-dimensional starting shape and through folding. This shape may also be referred to as the (three-dimensional) ready-to-use state. The three-dimensional form features one or several (two in the example shown) attachment lips (3) with which the clip is fastened to the data carrier, as well as a gripping section located between the attachment lips comprising two surfaces obtained through folding (resp. 4*a* and 4*b*), which from a side view form a roughly isosceles triangle.

The surfaces 4*a* and 4*b* may be referred to as the triangular surfaces 4*a* and 4*b* in the remainder of the description and in the conclusions. Due in part to this triangular shape of the gripping section, the clip has a considerable amount of stability and stiffness. To afford a quick and simple attachment of the clip to a stem, the clip comprises a V-shaped collector, further referred to as collector, which guides the stem into the actual gripping section, the capture hole (5), when the clip is pressed against a stem. The collector may have any shape suitable for gripping a branch and guiding it into the capture hole, and is therefore not limited to the V shape.

The invention allows for the clip to be manufactured from different sorts of materials, including e.g. paper, cardboard, and plastic. In a few preferred implementations of the clip, it is made out of plastic. The clip must be able to solidly grip stems of different thicknesses. It is therefore necessary for the clip to be resilient enough during the initial fastening to a stem, and retains that quality during transport of the product in the supply chain. Although it is not impossible to achieve this with paper or cardboard, the risk of tearing and the resulting loss of gripping capacities are higher with those materials. Furthermore, the humidity emanating from vegetables and fruits has a negative influence on the mechanical properties of paper and cardboard. The invention comprises all possible combinations of materials for the data carrier and the gripping element.

Many kinds of plastic, which from a costs point of view are a suitable material for manufacturing the clip according to the invention, have a high degree of elasticity, which ensures good gripping characteristics to a clip made from these materials.

Figure 2:
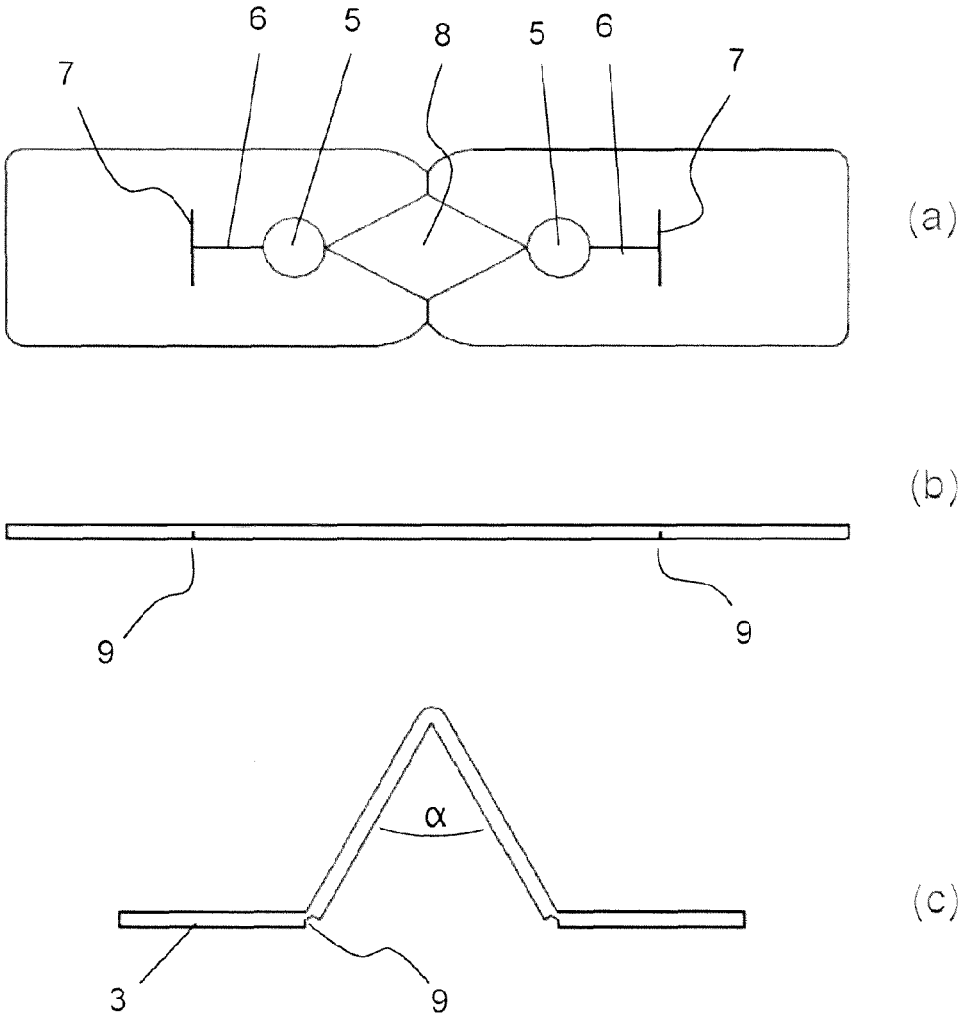
FIG. 2*a* a schematic full-scale representation of the implementation example represented schematically in FIG. 1 of the gripping element according to the invention.
FIG. 2*b* a schematic side view of the full-scale representation of the implementation example of the gripping element according to the invention shown in FIG. 2*a;*
FIG. 2*c* a schematic side view of the implementation example of the gripping element according to the invention shown in FIG. 2*a* under use.

FIG. 2*a* shows a full-scale representation of the implementation example of the clip according to the invention shown schematically in FIG. 1. In this implementation, the clip has a symmetrical shape along the longitudinal axis of the clip, and along a central axis perpendicular to the longitudinal axis of the clip.

The clip comprises two capture holes (5), which constitute the actual gripping sections, a cut running lengthwise along the clip from each capture hole (6), also referred to as longitudinal cut (6), and at the end of each longitudinal cut (6), and perpendicularly to each longitudinal cut (6), a transverse cut (7).

Preferably, the diameter of the capture hole (5) should be smaller than the smallest expected diameter of a stem to which the clip must be fastened. The cuts (6) and (7) ensure a high degree of deformation of the capture hole (5), without resulting in plastic deformation of the material of the clip, and therefore also ensure a higher elastic deformation. This means that the range of stem diameters that the clip can attach to is wide. In the example of the clip shown in FIG. 1, the transverse cut (7) perpendicular to the longitudinal direction of the clip coincides with a folding line of the clip, namely the folding line of the attachment lips (3). The invention however also covers implementation forms of the clip in which the distance from the capture hole to the transverse cut (7) is smaller than the distance from the capture hole to the folding line of the attachment lips (3). The diamond-shaped cut (8) in FIG. 2*a* is the full-scale representation of the V-shaped collector of this implementation example of the clip according to the invention.

Besides the material type and thickness from which the clip is made, the gripping range and the gripping force of the clip also determined by the length of the longitudinal cut (6) and the transverse cut (7).

FIG. 2*b* shows a schematic side view of the full-scale representation of the implementation example of the gripping element according to the invention shown in FIG. 2*a*. This clearly shows that there are two grooves in the clip, partially cutting through the thickness of the material. These cuts are indicated by the number (9). The cuts are situated at the location of the previously mentioned folding lines of the attachment lips (3).

FIG. 2*c* is a schematic side view of the implementation example of the clip according to the invention in its ready to use state, a three-dimensional state. The apex angle $\alpha$ has an influence on the strength and stiffness of the clip. Depending on the application, some preferred implementations of the clip have an apex angle $\alpha$ of about 5° to about 50° in the ready to use state.

If the apex angle is too small, the stability and stiffness of the gripping section of the clip may be too limited, and if the apex angle is too big, due to a too flat position of the capture holes (5), the gripping can be more difficult.

Figure 3:
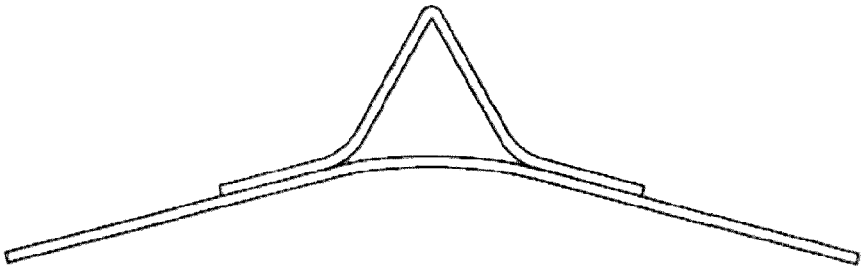
FIG. 3*a* a schematic side view of an implementation example of a data carrier with a clip attached to it without cuts at the folding lines for the attachment lips.
FIG. 3*b* a schematic side view of an implementation example of a data carrier with a clip attached to it with cuts at the folding lines for the attachment lips.
Figure 3:
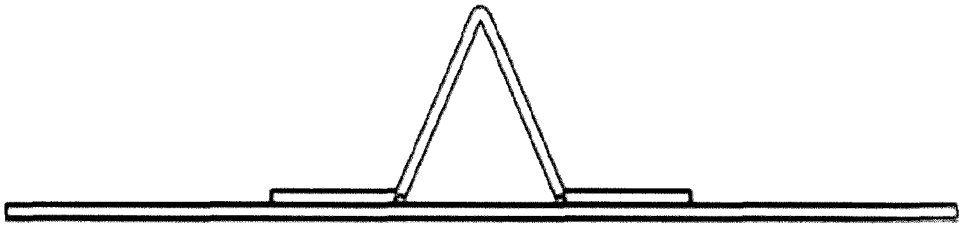

FIG. 3*a* shows a schematic side view of an implementation example of a data carrier with a clip attached to it without the cuts (9) at the folding lines of the attachment lips, mentioned while discussing FIG. 2*b*. Depending in part on the respective materials used to make the data carrier and the clip, and their thicknesses, the phenomenon illustrated schematically in FIG. 3*a* can happen if the cuts (9) are not made. The elastic pressures in the clip near the folding lines can lead to deformation, in this example a hollow pull, of the data carrier. This is obviously not pretty and should therefore be avoided.

FIG. 3*b* shows a schematic side view of the combination shown in FIG. 3*a* in which the clip is indeed cut at the folding lines of the attachment lips. The cuts ensure that the elastic pressures in the material of the clip at the folding lines remain low and that the data carrier largely retains its shape as a result.

Figure 4:
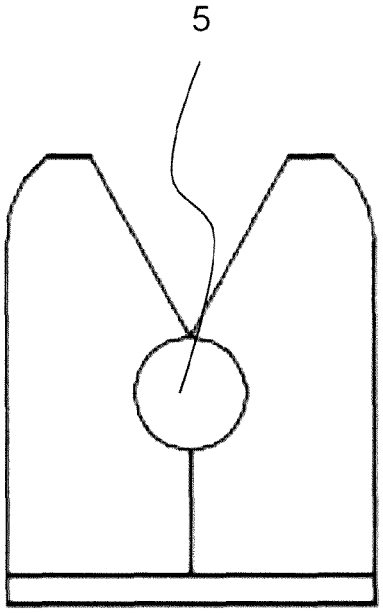
FIG. 4*a* a schematic front view of an implementation example of the gripping element according to the invention, ready for use.
FIG. 4*b* a schematic front view of the implementation example of the gripping element according to the invention shown in FIG. 3*a* with an opened capture hole.
Figure 4:
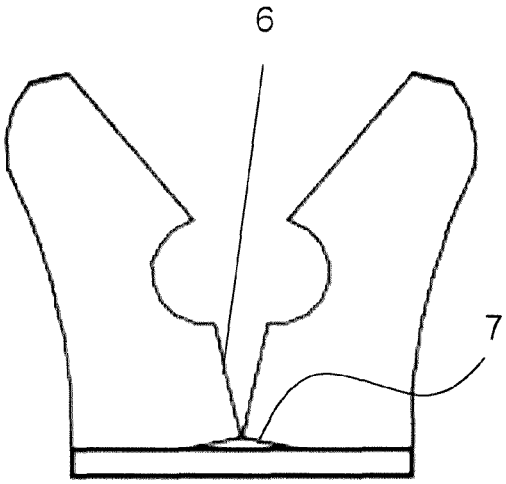

FIG. 4*a* shows a schematic front view of an implementation example of the clip according to the invention in its ready to use state. The capture hole (5) is still not deformed.

FIG. 4*b* is a schematic front view of the implementation example of the gripping element according to the invention shown in FIG. 4*a*, where the capture hole is open wide from pulling the sides of the clip away from each other. Due to the presence of the longitudinal cut (6) and the transverse cut (7), the degree of deformation of the capture hole given schematically here can be achieved without plastic deformation of the clip. This means that the clip will want to return to the resting state shown in FIG. 4*a*, after the removal of the forces which give the capture hole the shape represented schematically in FIG. 4*b*. The pressures in the clip in the state represented schematically in FIG. 4*b* are therefore preferably mainly elastic pressures which, when e.g. a stem is placed in the capture hold in that state, will result in a steady grip on the stem. The invention allows for this to be realised with a clip from a material with a limited thickness, making the required force for the elastic deformation of the clip small enough that hundreds of clips per hour can be applied manually.

With machine application of clips, the rate will be thousands per hour. The mostly triangular shape of the gripping section of the clip in the ready to use state, where both capture holes (5) of the clip are each located in a leg of the triangle, ensures a double grip, improving the gripping effect.

While the figures discussed until now show implementation examples of the clip with an essentially round capture hole (5), the invention also allows the clip to not feature a round capture hole, but a different kind of capture hole or capture profile, which can further all be designated as capture hole (5) for the sake of convenience. Furthermore, the invention comprises implementation forms of the clip where the capture hole doesn't have an essentially smooth edge, but an edge with e.g. a sawtooth profile or another kind of profile, which can improve the grip in some cases.

Figure 5:
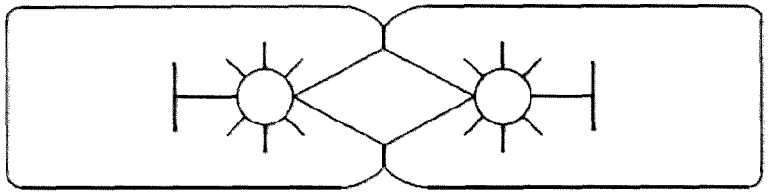
FIG. 5 a schematic full-scale view of three variations of the clip according to the invention.
Figure 5:
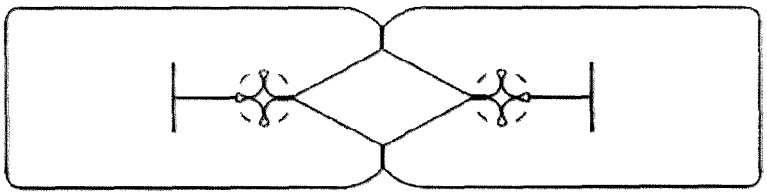
Figure 5:
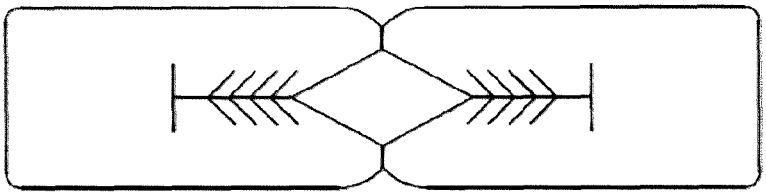

FIG. 5 shows a schematic full-scale view of three different implementation examples of the clip according to the invention, which are self-explanatory. In the case of these variants as well, the gripping section features measures which ensure that thanks to elastic pressures in the material of the clip, a large range of stem diameters can be gripped strongly enough.

Figure 6:
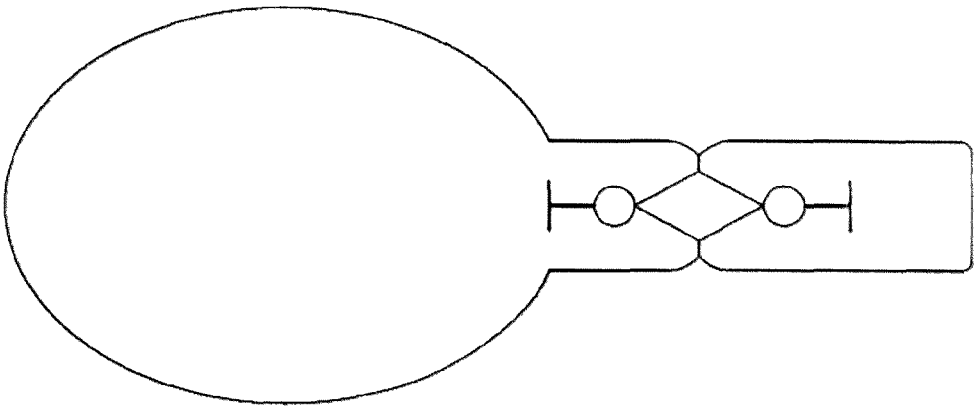
FIG. 6*a* a schematic full-scale view of a clip according to the invention where the clip and data carrier form an integrated whole.
FIG. 6*b* a schematic side view of the implementation example shown in FIG. 5*a*, ready for use.
Figure 6:
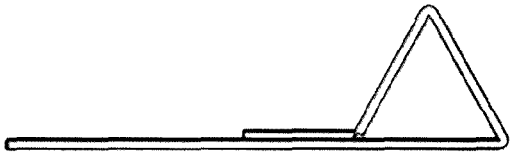

The description and the figures discuss and show loose implementation examples of the clip according to the invention, to be attached to a data carrier using e.g. glue. However, the invention also comprises implementation forms in which the clip, comprising one or several attachment lips and two triangular surfaces with capture holes, longitudinal cuts and transverse cuts, forms an integral part of a label. FIG. 6*a* shows a schematic top view of a full-scale representation of an implementation example of such a clip according to the invention. FIG. 6*b* shows a schematic side view of this clip after the clip has been brought into its state ready for use. In this implementation form, the clip therefore only comprises one attachment lip.

Besides the clip itself, the invention also covers the process for machine manufacturing the clip according to the invention and for folding the clip into its (three-dimensional) state ready for use, as well as a design for the application of this process.

The invention claimed is:

1. A gripping element and a data carrier with which gripping element and the data carrier can be clicked onto a branch of vegetables or fruits, or a stem, branch or stake of a plant, or as a tie up element for plastic bags, wherein the gripping element in its fabricated state is an essentially two dimensional object made from thin material, and which can be folded into a three dimensional gripping element, wherein the gripping element in its three dimensional ready for use state comprises several attachment lips with which the gripping element is attached to the data carrier and a gripping section located between the attachment lips, the gripping section comprising two surfaces forming legs of a triangle with an angle between them in said ready to use state of the gripping element which from a side view give the gripping section a triangular shape, wherein each of said surfaces comprises a capture hole, wherein each of said surfaces comprises a longitudinal cut, and wherein each of said surfaces comprises a transverse cut provided at an end of the corresponding longitudinal cut and lying at the side of its corresponding attachment lip interspaced from the capture hole with the longitudinal cut extending between them.

2. The gripping element and data carrier according to claim 1, wherein the gripping section of the gripping element comprises a collector.

3. The gripping element and data carrier according to claim 1, wherein one or several of the attachment lips are delimited on one side by a folding line, comprising a groove.

4. The gripping element and data carrier according to claim 1, wherein the angle between both triangular surfaces in the ready to use state of the gripping element amounts to at least three degrees and at most sixty degrees.

5. The gripping element and data carrier according to claim 4, wherein the angle between both of said surfaces in the ready to use state of the gripping element, amounts to at least five degrees and at most fifty degrees.

6. A process for manufacturing the gripping element and data carrier according to claim 1, comprising the steps:

folding the gripping element into said three-dimensional ready to use state; and attaching the gripping element with its attachment lips to the data carrier.

7. The gripping element according to claim 1, wherein each transverse cut coincides with a folding line of its corresponding attachment lip.

8. The gripping element and data carrier according to claim 1, wherein the gripping element is made out of plastic.

9. The gripping element and data carrier according to claim 1, wherein the data carrier and the gripping element are made out of a combination of materials.

10. The gripping element and data carrier according to claim 1, wherein the two surfaces in said ready to use state from a side view give the gripping section a substantially isosceles triangular shape.

* * * * *